US006298917B1

(12) United States Patent
Kobylinski et al.

(10) Patent No.: US 6,298,917 B1
(45) **Date of Patent: *Oct. 9, 2001**

(54) COILED TUBING SYSTEM FOR COMBINATION WITH A SUBMERGIBLE PUMP

(75) Inventors: Lee S. Kobylinski; Kevin T. Scarsdale, both of Bartlesville, OK (US)

(73) Assignee: Camco International, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/128,531

(22) Filed: Aug. 3, 1998

(51) Int. Cl.[7] ..... E21B 23/00; E21B 19/22; E21B 43/00

(52) U.S. Cl. ..... 166/369; 166/65.1; 166/105; 166/242.2; 166/385

(58) Field of Search ..... 166/384, 385, 166/65.1, 242.1, 105, 380, 242.2, 369

(56) References Cited

U.S. PATENT DOCUMENTS

| | | | | |
|---|---|---|---|---|
| 4,346,256 | | 8/1982 | Hubbard et al. | 174/47 |
| 4,621,689 | | 11/1986 | Brookbank, III | 166/106 |
| 4,627,490 | | 12/1986 | Moore | 166/65.1 |
| 4,644,094 | | 2/1987 | Hoffman | 174/47 |
| 4,708,201 | | 11/1987 | Reed | 166/65.1 |
| 4,743,711 | | 5/1988 | Hoffman | 174/109 |
| 4,830,113 | * | 5/1989 | Geyer | 166/369 |
| 4,913,239 | | 4/1990 | Bayh, III | 166/385 |
| 4,928,771 | | 5/1990 | Vandevier | 166/385 |
| 4,971,147 | | 11/1990 | Thomeer | 166/65.1 |
| 5,070,940 | * | 12/1991 | Conner et al. | 166/65.1 |
| 5,145,007 | * | 9/1992 | Dinkins | 166/386 |
| 5,146,982 | * | 9/1992 | Dinkins | 166/65.1 |
| 5,172,765 | | 12/1992 | Sas-Jaworsky et al. | 166/384 |
| 5,193,614 | | 3/1993 | Cox | 166/65.1 |
| 5,207,273 | | 5/1993 | Cates et al. | 166/369 |
| 5,269,377 | | 12/1993 | Martin | 166/385 |
| 5,334,801 | | 8/1994 | Mohn | 174/47 |
| 5,384,430 | | 1/1995 | Anthony et al. | 174/115 |
| 5,495,547 | * | 2/1996 | Rafie et al. | 385/101 |
| 5,528,824 | | 6/1996 | Anthony et al. | 29/828 |
| 5,542,472 | | 8/1996 | Pringle et al. | 166/65.1 |
| 5,821,452 | * | 10/1998 | Neuroth et al. | 174/28 |
| 5,848,642 | * | 12/1998 | Sola | 166/77.2 |
| 5,906,242 | * | 5/1999 | Bruewer et al. | 166/378 |

FOREIGN PATENT DOCUMENTS

| | | |
|---|---|---|
| 0 505 815 | 9/1992 | (EP) . |
| 0 565 287 | 10/1993 | (EP) . |
| 2 322 393 | 8/1998 | (GB) . |

* cited by examiner

*Primary Examiner*—Hoang Dang
(74) *Attorney, Agent, or Firm*—Fletcher, Yoder & Van Someren

(57) ABSTRACT

A coiled tubing system deploys an electric submergible pump system within a wellbore. The coiled tubing system includes an internal power cable for providing power to a submergible motor. Additionally, a control line, such as a hydraulic line, is disposed within the hollow interior of the coiled tubing to provide an input to the submergible pumping system. The control line is preferably routed through an interior space of a connector unit disposed between the coiled tubing and the submergible motor.

20 Claims, 4 Drawing Sheets

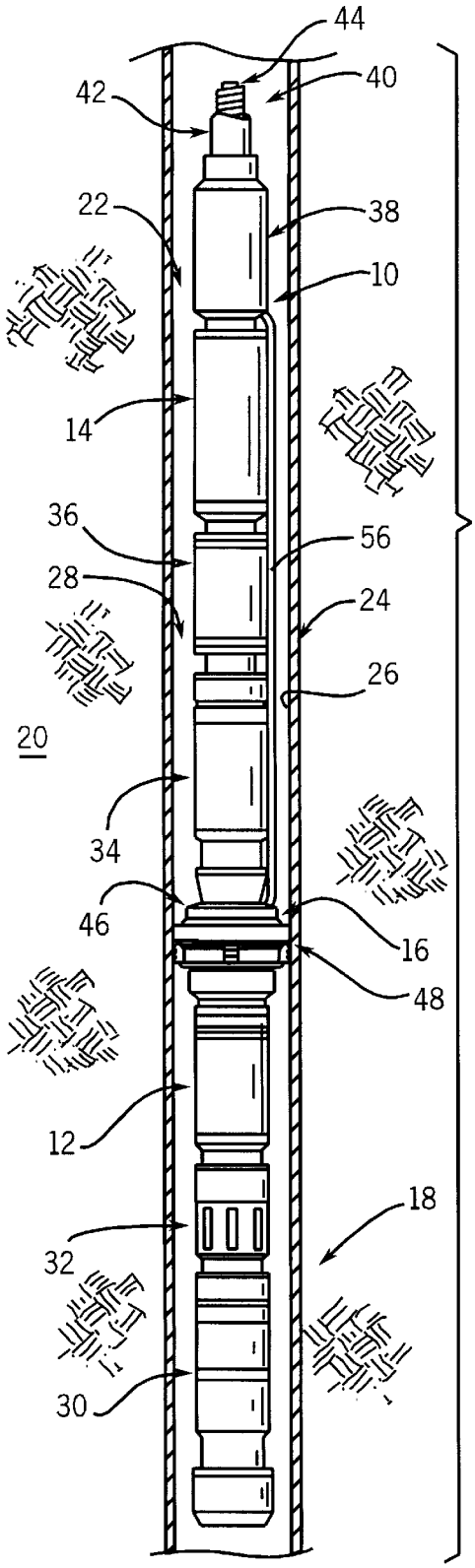
FIG. 1
FIG. 2
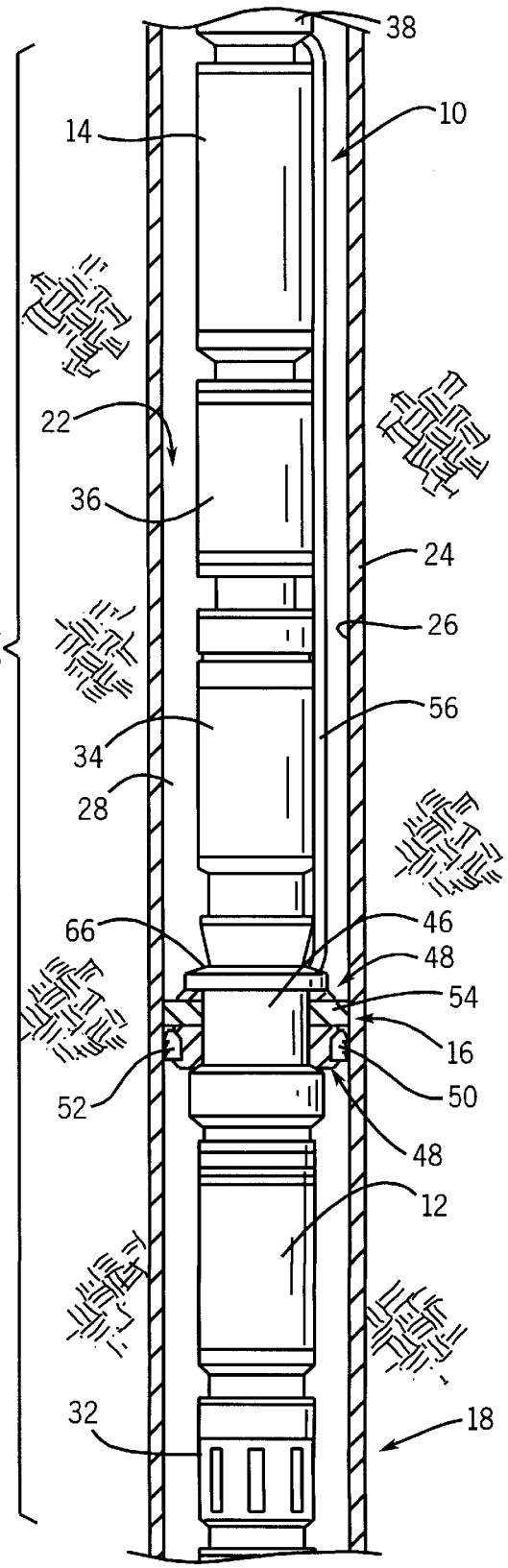

COILED TUBING SYSTEM FOR COMBINATION WITH A SUBMERGIBLE PUMP

FIELD OF THE INVENTION

The present invention relates generally to submergible pumping systems for raising fluids from wells and, particularly, to a coiled tubing system that integrates combined conductors for providing power to a submergible electric motor of the pump system and at least one other control line to provide other input to the system.

BACKGROUND OF THE INVENTION

In producing petroleum and other useful fluids from production walls, it is generally known to provide a submergible pumping system for raising the fluids collected in a well. Production fluids enter a wellbore via perforations formed in a well casing adjacent a production formation. Fluids contained in the formation collect in the wellbore and may be raised by the submergible pumping system to a collection point above the earth's surface.

In a conventional bottom intake electric submergible pumping system, the system includes several components, such as a submergible electrical motor that supplies energy to a submergible pump. The system may further include a motor protector for isolating the motor from well fluids. A motor connector may also be used to provide a connection between the electrical motor and an electrical power supply. These and other components may be combined in the overall submergible pumping system.

Conventional submergible pumping systems are suspended within a wellbore by support tubing or by a cable. Power is supplied to the submergible electric motor by a power cable that is banded to the cable or support tubing. The banding is required because otherwise the unsupported weight of the power cable can damage or break the power cable. Coiled tubing is also used to install electric submergible pumping systems into a well. Coiled tubing provides a relatively fast and uninterrupted method for installation and retrieval of the pumping system. With coiled tubing, the power cable is either banded to the outside of the coiled tubing or disposed internally within the hollow interior formed by the coiled tubing.

Existing power cables may contain conductors for powering the motor, typically three conductors. Any other inputs to the electric submergible pumping system must be provided by a separate line, typically banded to the outside of the tubing, support cable, or coiled tubing. This, of course, leaves the additional input or control line susceptible to damage due to its location external to the submergible pumping system and system support, e.g., coiled tubing. Consequently, it would be advantageous to combine coiled tubing with an internal power cable and additional control line or control lines disposed within the hollow interior of the coiled tubing. The control line could be used to supply hydraulic fluid for the control of devices, such as a hydraulically actuated integral packer. It also could be used to supply chemical treatments into the production fluid, such as corrosion control or scale inhibitor fluids, or to provide electrical or optical inputs to additional devices or sensors within the submergible pumping system.

SUMMARY OF THE INVENTION

The present invention features a coiled tubing system for use in deploying a submergible pump system. The submergible pump system includes a motor and a pump that are disposed within a wellbore of a well containing production fluids. The system comprises an outer coiled tubing having a longitudinal hollow interior. A power cable is disposed within the longitudinal hollow interior and includes a plurality of conductors. The conductors are disposed within an insulative core and an outer armor layer wrapped about the insulative core. The plurality of power conductors are adapted to provide power to the submergible motor. Additionally, a control line is disposed within the outer armor layer and runs along the length of the power cable to provide a desired control input to the submergible pump system.

According to another aspect of the present invention, a submergible pumping system is designed for deployment by coiled tubing within a wellbore. The submergible pumping system includes a connector assembly, a submergible motor, and a submergible pump. The connector assembly, submergible motor, and submergible pump are combined in a submergible pumping system for deployment in the wellbore. The pumping system also comprises a coiled tubing system that extends between the connector assembly and a position proximate a surface outlet of the wellbore. The coiled tubing system has outer coiled tubing forming a generally hollow interior. A plurality of conductors extend through the hollow interior and into the connector assembly for connection to the submergible motor. Additionally, a tubular member extends through the hollow interior to supply a desired fluid to the submergible pumping system.

According to another aspect of the present invention, a method is provided for communicating various inputs to a submergible pumping system having at least a connector assembly, a submergible motor, and a submergible pump. The method includes connecting a coiled tubing to the connector assembly of the submergible pumping system and suspending the pumping system within a wellbore via the coiled tubing. The method also includes deploying a power cable, having a plurality of conductors, within an interior hollow region of the coiled tubing and connecting the plurality of conductors to the submergible motor. The method further includes deploying a control line, independent of the plurality of conductors, through the interior hollow region of the coiled tubing.

BRIEF DESCRIPTION OF THE DRAWINGS

The invention will hereafter be described with reference to the accompanying drawings, wherein like reference numerals denote like elements, and:

FIG. 1 is a front elevational view of a submergible pumping system positioned in a wellbore, according to a preferred embodiment of the present invention;

FIG. 2 shows a packer assembly, according to a preferred embodiment of the present invention, disposed within the string of submergible pumping system components;

DETAILED DESCRPITION OF THE PREFERRED EMBODIMENTS

Figure 3:
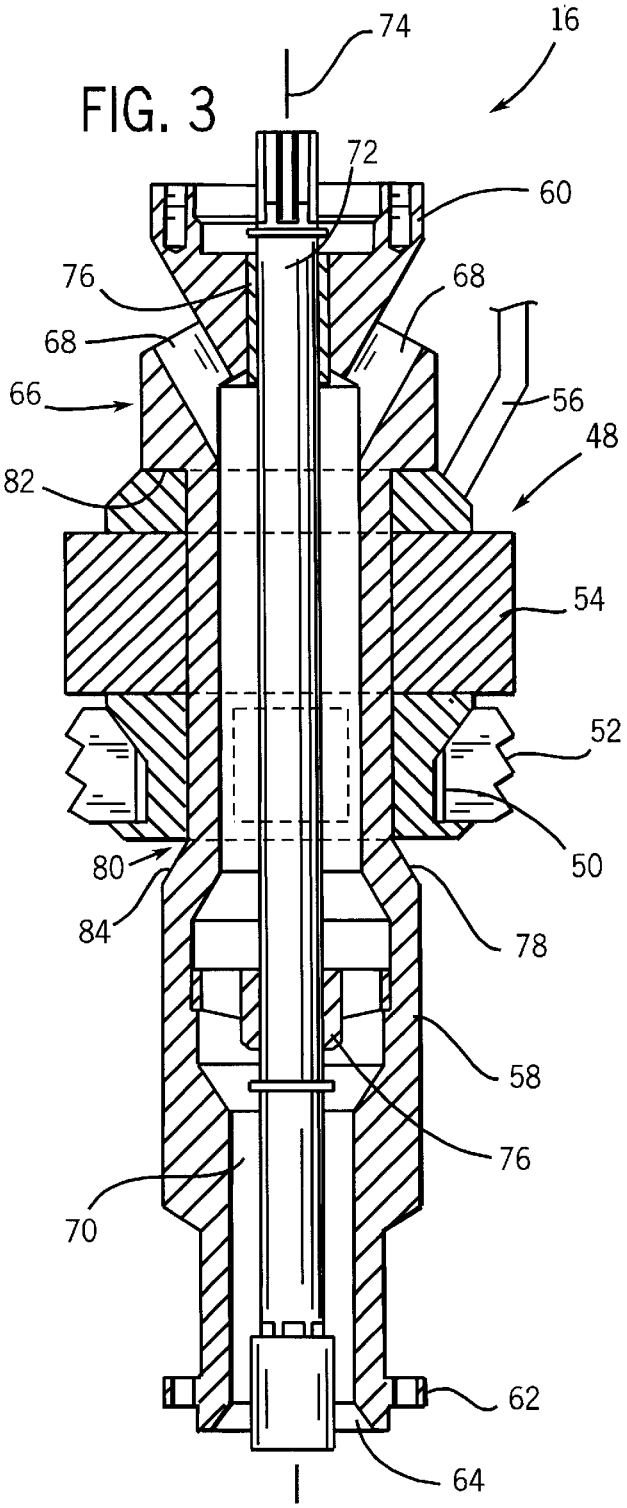
FIG. 3 is a cross-sectional view of the packer assembly illustrated in FIG. 2, taken generally along its longitudinal axes.

Referring generally to FIG. 1, a bottom intake electric submergible pump system 10 is illustrated according to a preferred embodiment of the present invention. Submergible pump system 10 may comprise a variety of components depending on the particular application or environment in which it is used. However, system 10 typically includes at least a submergible pump 12, submergible motor 14, and an integral packer assembly 16. The provision of integral packer assembly 16, within submergible pumping system 10, obviates the need for external seating shoes, running a separate liner, employing landing nipples, or deploying a separate packer prior to deployment of submergible pumping system 10.

As illustrated, system 10 is designed for deployment in a well 18 within a geological formation 20 containing desirable production fluids, such as petroleum. In a typical application, a wellbore 22 is drilled and lined with a wellbore casing 24. The submergible pumping system is then deployed within wellbore 22 to a desired location for retrieval of wellbore fluids. At this location, packer assembly 16 is set and sealed against an interior surface 26 of wellbore casing 24. The production fluids may then be pumped from well 18 via pump 12, powered by motor 14, to a point above packer assembly 16 and discharged into the annulus 28 formed between submergible pumping system 10 and interior surface 26 of wellbore casing 24. As the wellbore fluids are continually pumped into annulus 28 above packer assembly 16, the fluid level rises to a point at or above the earth's surface where the production fluid is collected for further processing.

As illustrated, submergible pumping system 10 typically includes additional components, such as a thrust casing 30, a pump intake 32, through which wellbore fluids enter pump 12, a protector 34, that serves to isolate the well fluid from the motor oil, and an injection line 36. Additionally, a connector 38 is used to connect motor 14 with a deployment system, such as tubing, cable or coil tubing. In the preferred embodiment, the deployment system is a coiled tubing system 40 utilizing a coiled tube 42 having a power cable 44 running through its hollow center as will be described in detail below.

Furthermore, a variety of motors 14 and pumps 12 can be used in submergible pumping system 10. However, an exemplary motor 14 is a three-phase, induction-type motor, and exemplary pump 12 is a multi-staged centrifugal pump. Additionally, additional components can be added, components can be removed, or the sequence of components can be rearranged according to the desired application.

Referring now also to FIGS. 2 and 3, packer assembly 16 includes a discharge head or packer mandrel 46 and a packer 48 integrally mounted on packer mandrel 46 for movement with packer mandrel 46 and the rest of submergible pumping system 10 as it is deployed at a specific location within wellbore 22 or removed from wellbore 22.

Packer 48 is illustrated in simplified form, because a variety of conventional packers can be adapted for use with this submergible pumping system 10. For example, packer 48 may be a mechanically set packer, such as a "J" latch-type packer, a Swab Cup-type packer, or a hydraulic packer. Preferably, packer 48 is a hydraulic packer, such as the Camco HRP-1-SP hydraulic set packer available through Camco International, Inc. of Houston, Tex. A hydraulic set packer generally includes a plurality of slips 50 having friction blocks 52 and a sealing element 54. Slips 50 and friction blocks 52 are deployed against interior surface 26 of casing 24 to hold packer assembly 16 at a given location within wellbore 22. Sealing element 54 typically comprises an elastomeric element that expands to seal between packer mandrel 46 and casing 24 to support the column of production fluid within annulus 28. The specific configuration of packer 48 will depend on the application and the desires of the submergible pumping system operator.

A control line 56 preferably is run from a location at the earth's surface to packer assembly 16 to "set" or engage packer 48 with wellbore casing 24 when desired. In the illustrated embodiment, control line 56 is a hydraulic line that supplies hydraulic fluid to packer 48, thereby providing inputs to selectively set the packer.

Figure 4:
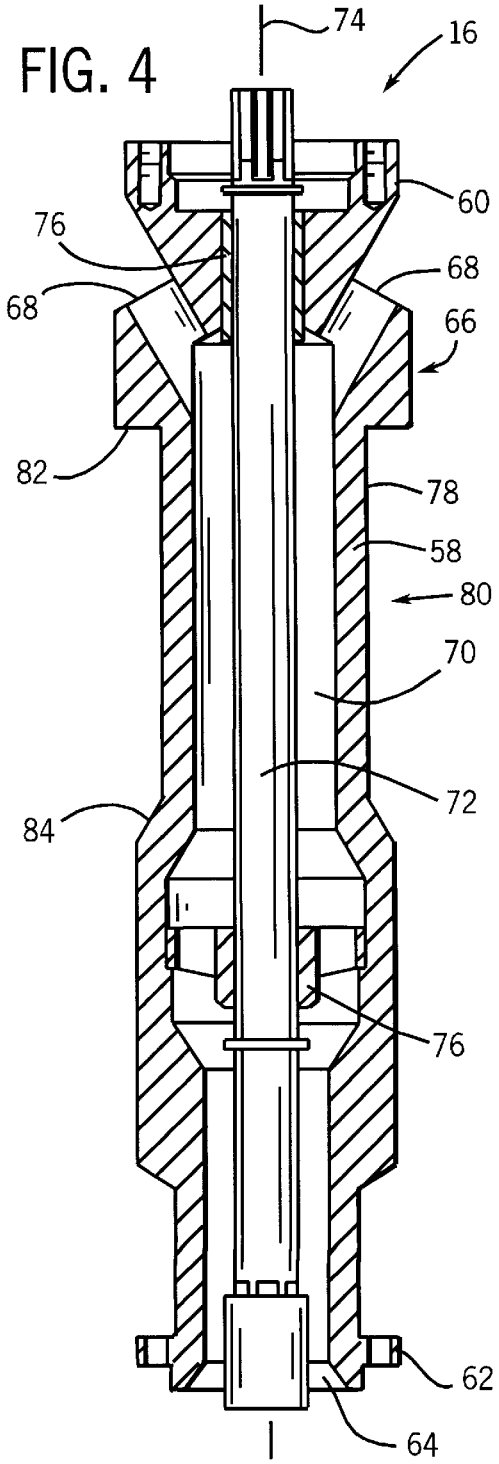
FIG. 4 is a cross-sectional view of the packer mandrel taken generally along its longitudinal axis.

Referring also to FIG. 4, packer mandrel 46 includes a housing 58 that has an upper connector end 60 and a lower connector end 62. Upper connector end 60 is connected, for instance, to the lower portion of protector 34 while lower connector end 62 is connected to, for instance, the upper end of submergible pump 12. Thus, packer mandrel 46 is disposed intermediate pump 12 and motor 14 with motor 14 being disposed above packer mandrel 46 within wellbore 22 while pump 12 is disposed below packer mandrel 46 in wellbore 22.

Housing 58 includes an inlet 64 and a discharge end 66 having an outlet 68. A fluid passage 70 connects inlet 64 and outlet 68 through the interior of housing 58 to permit the flow of wellbore fluids therethrough. Thus, wellbore fluids are taken in through intake 32, pumped through the interior of submergible pump 12 and through fluid passage 70 before entering annulus 28 via outlet 68.

A shaft 72 extends through the center of housing 58 generally along a longitudinal axis 74 to provide power from motor 14 to pump 12. Preferably, shaft 72 extends through the center of fluid passage 70. Bearings, and preferably a pair of bearings 76, hold and support shaft 72 for rotation within housing 58.

Housing 58 is designed to secure packer 48 thereto so that packer 48 is retained as an integral component of submergible pumping system 10 as it is deployed and moved within wellbore 22. In other words, the various components, including packer 48, may be assembled at the surface and deployed in wellbore 22 at any desired location without first deploying a separate packer in a preliminary step and/or without using any seating shoes, separate liners, or landing nipples that fix the location of submergible pumping system 10 at a specific location within wellbore 22. Additionally, because packer 48 is independently controlled via control line 56, it can be set at any time regardless of whether pump 12 has been started or any pumping action has occurred. Specifically, this allows packer 48 to be set at the desired location within wellbore 22 prior to initiation of any pumping action.

In the preferred embodiment, housing 58 includes an exterior surface 78 that forms an engagement region, preferably a recessed region 80, for holding packer 48, as best illustrated in FIG. 3. In this embodiment, recessed region 80 is formed by an upper expanded region 82 of exterior surface 78 and a lower expanded region 84 of exterior surface 78. Packer 48 is held within this recessed region 80 so that it is constrained to movement with packer mandrel 46 and thus submergible pumping system 10. Packer 48 may, for instance, be assembled within recessed region 80 or packer mandrel 46 potentially can be formed as two or more components that are inserted into packer 48 and fastened together by, for instance, a weldment, bolts, or other fasteners. Additionally, packer 48 may be attached to housing 58 at additional points by additional fasteners, weldments, or splines to prevent any rotation of packer 48 with respect to housing 58.

Figure 5:
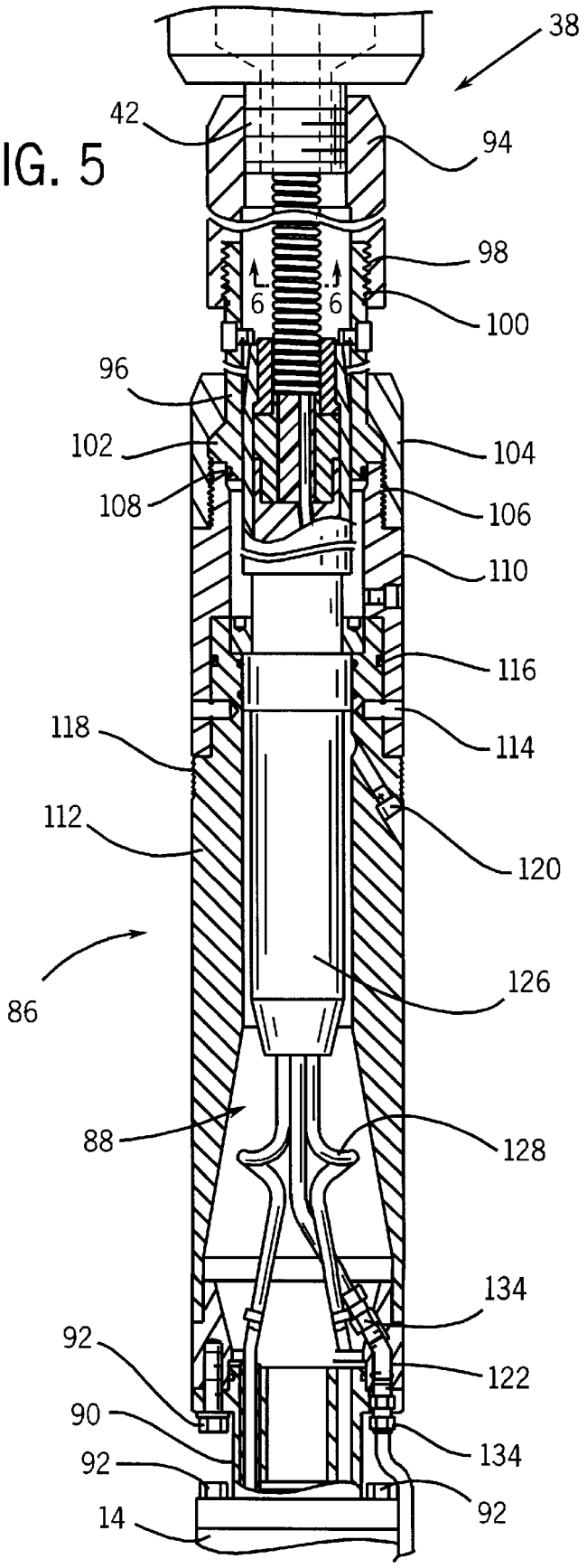
FIG. 5 is a cross-sectional view of a connector, according to a preferred embodiment of the present invention.

Referring generally to FIG. 5, a cross-sectional view of connector assembly 38 is taken generally along a longitudinal axis of connector assembly 38. In the preferred embodiment, connector assembly 38 includes an outer housing 86 that has an interior hollow region 88. Connector assembly 38 includes a lower mounting structure 90 by which it is connected to the next sequential component, preferably motor 14, of submergible pumping system 10. Lower mounting structure 90 may be designed for connection to motor 14 and housing 86 via a plurality of fasteners 92, such as bolts.

In the illustrated embodiment, connector assembly 38 includes a head connector 94 that engages coiled tubing 42. Opposite coiled tubing 42, head connector 94 engages a housing connector 96 via a threaded region 98 and a sealing ring 100. Housing connector 96 includes a radially outwardly extending flange 102 that abuts against a top portion of housing 86. Housing connector 96 and housing 86 are held together by a union 104 that threadably engages housing 86 at a threaded region 106 to pull flange 102 tightly against the top of housing 86, as illustrated in FIG. 5. A seal 108 is disposed between housing connector 96 and housing 86.

Housing 86 includes a collar connector 110 having threaded region 106 disposed along its upper portion. Collar connector 110 is connected to a lower housing connector 112 by a plurality of shear pins 114 and sealed thereto by a seal ring 116. Thus, if submergible pumping system 10 becomes stuck within wellbore 22, head connector 94 and collar connector 110 may be sheared away from lower housing connector 112. Lower housing connector 112 includes a plurality of fishing teeth 118 to permit later retrieval of the remainder of submergible pumping system 10, as is well known by those of ordinary skill in the art.

Housing 86 also includes a drain 120 for draining fluids, as necessary, from interior hollow region 88. Specifically, drain 120 extends through housing 86 from interior hollow region 88 to wellbore 22. Preferably, housing 86 further includes an outlet 122 that can be used to conduct control line 56 from interior hollow region 88 to annulus 28 between submergible pumping system 10 and wellbore casing 24.

Figure 6:
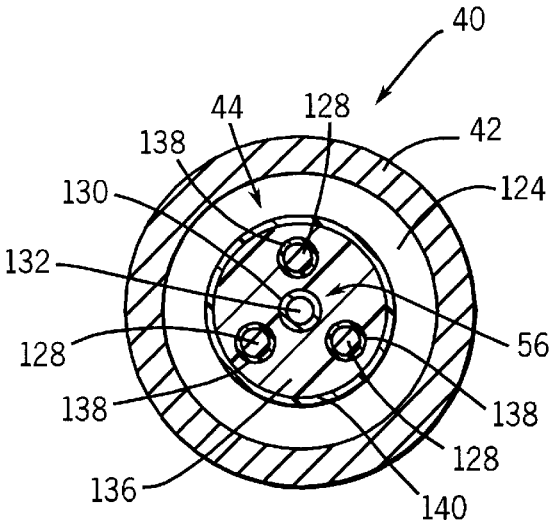
FIG. 6 is a cross-sectional view taken generally along line 6—6 of FIG. 5.

With additional reference to FIG. 6, the present invention preferably utilizes coiled tubing system 40 in which the outer coiled tubing 42 is connected to head connector 94 to suspend submergible pumping system 10 as it is deployed within wellbore 22. Power cable 44 extends through a longitudinal hollow interior 124 of coiled tubing 42. Power cable 44 extends into the interior of housing connector 96 and engages a penetrator 126. Penetrator 126 conducts a plurality of motor conductors 128 to a lower portion of interior hollow region 88 of housing 86. From this point, the individual motor conductors, typically three motor conductors 128, are directed through lower mounting structure 90 for connection with motor 14 to provide appropriate electrical input thereto.

In the preferred embodiment, power cable 44 also includes, as an integral component, control line 56. As illustrated best in FIG. 6, control line 56 may comprise an injection line having an outer wall 130 defining an interior fluid passage 132 for conducting, for instance, hydraulic fluid to packer 48.

In the preferred embodiment illustrated in FIGS. 5 and 6, control line 56 is disposed generally at a central location between electrical motor conductors 128 within power cable 44. The hydraulic control line is then routed through penetrator 126 and out of connector assembly 38 via outlet 122, as illustrated best in FIG. 5. From outlet 122, control line 56 is routed along motor 14 and any other components of submergible pumping system 10 until it reaches packer 48, where it may be connected in a conventional manner. Control line 56 may comprise multiple pieces and also may be held securely in place at outlet 122 by appropriate fasteners 134.

In the preferred embodiment, power cable 44 includes control line 56 disposed generally along its longitudinal axis and through an insulative core 136. Each of the three electrical motor conductors 128 is spaced radially outward from control line 56 and also runs through insulative core 136. Each of the motor conductors 128 may be sheathed in an outer insulative layer 138 that is disposed through insulative core 136, as is understood by those of ordinary skill in the art. Preferably, insulative core 136 is surrounded by an armor layer 140, such as a metallic layer, for added strength and protection.

Figure 7:
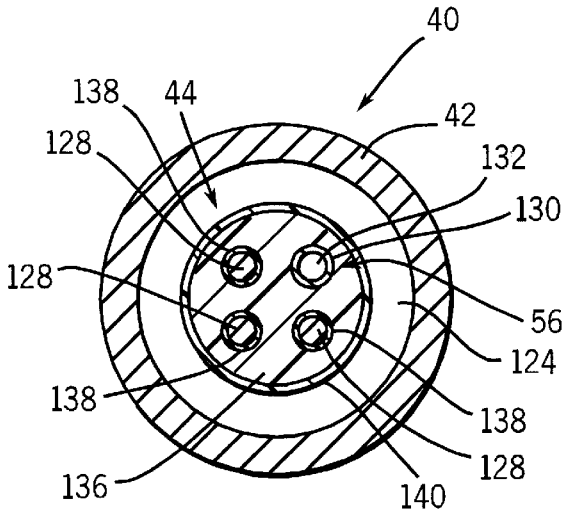
FIG. 7 is an alternate embodiment of the combined power cable and coiled tubing illustrated in FIG. 6.
Figure 8:
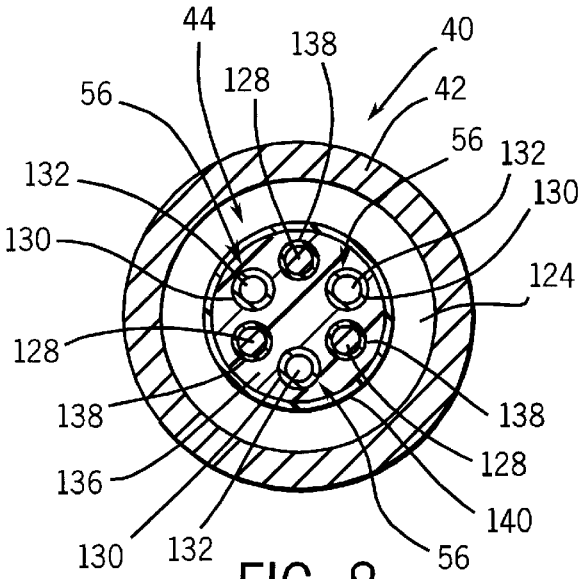
FIG. 8 is an alternate embodiment of the combined power cable and coiled tubing illustrated in FIG. 6.
Figure 9:
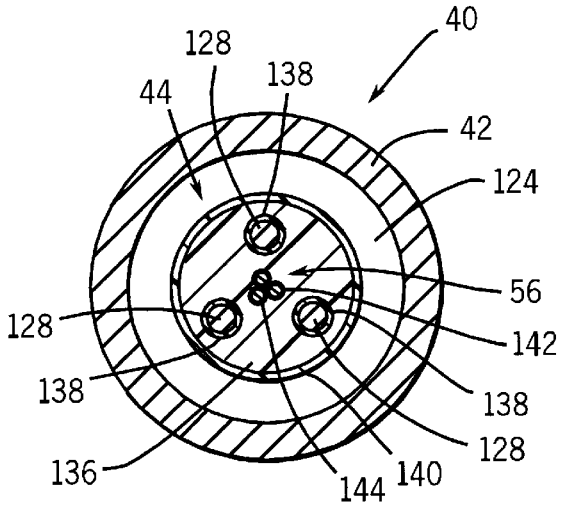
FIG. 9 is an alternate embodiment of the combined power cable and coiled tubing illustrated in FIG. 6.

Although FIG. 6 illustrates the preferred embodiment, a variety of alternate embodiments may be employed, such as those illustrated in FIGS. 7–9. For example, in FIG. 7, control line 56 is disposed through insulative core 136 at a position radially outward from the radial center of power cable 44. In either of the embodiments illustrated in FIG. 6 or 7, control line 56 may comprise an injection line for carrying fluid, such as hydraulic fluid, to packer 48 or other components requiring independent input and actuation. When control line 56 is utilized as an injection line, it does not necessarily need to be used for powering the packer 48 of the preferred embodiment; it also could be used to inject chemical treatment into the production fluid for corrosion control, scale inhibition, etc.

In the alternate embodiment illustrated in FIG. 8, there are a plurality of control lines 56 for independently carrying hydraulic fluid, chemical treatment, or other fluids to various components or locations along submergible pumping system 10. The multiple control lines potentially can be routed through connector assembly 38 or around connector assembly 38 along annulus 28. As illustrated in FIG. 9, control line 56 also may comprise lines for carrying other types of inputs to submergible pumping system 10. For example, control line 56 may comprise an electrical conductor, such as a twisted pair 142 and/or an optical fiber 144 for carrying inputs to selected components of submergible pumping system 10, such as down hole sensors. Additionally, control line or lines 56 may comprise a mixture of control line types, e.g., hydraulic fluid injection lines, electrical conductors or optical fibers.

It will be understood that the foregoing description is of preferred embodiments of this invention, and that the invention is not limited to the specific forms shown. For example, a variety of packers and packer mandrel configurations may be adapted for use in a particular down hole environment; the submergible pumping system may incorporate a variety of additional or different components; the specific design of the connector assembly may incorporate different components and configurations; and the power cable may be constructed in various configurations of a variety of materials conducive for use in a down hole environment. These and other modifications may be made in the design and arrangement of the elements without departing from the scope of the invention as expressed in the appended claims.

What is claimed is:

1. A coiled tubing system for use in deploying a submergible pump system, including a motor and a pump, within a wellbore, comprising:

an outer coiled tubing having a longitudinal hollow interior;

a power cable disposed within the longitudinal hollow interior, the power cable including a plurality of conductors disposed within an insulative core and an outer armor layer disposed about the insulative core, the plurality of power conductors being adapted to provide power to the motor;

a control line disposed within the outer armor layer; and a connector coupled to the outer coiled tubing and adapted for connection to the submergible pump system, the plurality of conductors and the control line extending at least partially through the connector, wherein the connector comprises a mechanism to selectively separate the coiled tubing from the submergible pump system while at a downhole location.

2. The coiled tubing system as recited in claim 1, wherein the control line includes an internal passageway for conducting a control fluid.

3. The coiled tubing system as recited in claim 1, wherein the control line comprises an electrical conductor.

4. The coiled tubing system as recited in claim 1, wherein the control line comprises an optical fiber.

5. The coiled tubing system as recited in claim 1, further comprising a connector assembly to which a terminal end of the outer coiled tubing is connected, the connector assembly including a connector housing and an internal passageway into which the plurality of conductors and the control line extend.

6. The coiled tubing system as recited in claim 5, wherein the connector assembly includes an outlet through which the control line is directed to the exterior of the connector housing.

7. The coiled tubing system as recited in claim 6, wherein the control line comprises an internal passageway for conducting a control fluid.

8. The coiled tubing system as recited in claim 7, wherein the control fluid is a hydraulic fluid.

9. The coiled tubing system as recited in claim 5, wherein the connector assembly includes an upper connector and a lower connector attached to one another by a shear mechanism that allows the upper connector to be sheared from the lower connector.

10. The coiled tubing system as recited in claim 5, further comprising a submergible motor to which the connector assembly is attached, wherein the plurality of conductors are connected to the submergible motor to supply power to the submergible motor.

11. A submergible pumping system for deployment by coiled tubing within a wellbore, comprising:

a connector assembly;

a submergible motor;

a submergible pump, wherein the submergible motor and the submergible pump are combined in a submergible pumping system for deployment in the wellbore; and a coiled tubing system extending between the connector assembly and a position proximate the surface outlet of the wellbore, the coiled tubing system having an outer coiled tubing forming a generally hollow interior, a plurality of conductors extending through the hollow interior and into the connector assembly for connection to the submergible motor, and a tubular member extending through the hollow interior to supply a desired fluid to the submergible pumping system; wherein the connector assembly comprises a mechanism to selectively separate the coiled tubing system from the submergible pumping system while at a downhole location.

12. The submergible pumping system as recited in claim 1, wherein the tubular member comprises a hydraulic control line.

13. The submergible pumping system as recited in claim 11, wherein the plurality of conductors and the tubular member are held within an insulative core.

14. The submergible pumping system as recited in claim 13, wherein the insulative core is surrounded by an outer armor layer.

15. The submergible pumping system as recited in claim 14, wherein the plurality of conductors comprise three conductors and further wherein the tubular member substantially extends along an axial center of the insulative core and the three conductors extend through the insulative core at locations radially outward from the tubular member.

16. A method for communicating various inputs to a submergible pumping system having at least a connector assembly, a submergible motor and a submergible pump, comprising:

connecting tubing to the connector assembly of the submergible pumping system;

suspending the submergible pumping system within a wellbore by the tubing;

deploying a premanufactured power cable, having a plurality of conductors and a control line, within an interior hollow region of the tubing;

connecting the plurality of conductors to the submergible motor; and providing a mechanism for selectively separating the tubing from the submergible pumping system while at a downhole location.

17. The method as recited in claim 16, further comprising containing the plurality of conductors and the control line within an insulative core.

18. The method as recited in claim 17, further comprising surround the insulative core with an outer armor layer.

19. The method as recited in claim 18, wherein the step of deploying a control line includes deploying a fluid control line for carrying a control fluid.

20. The method as recited in claim 19, further comprising directing the fluid control line into an interior region of the connector assembly and then out of the connector assembly through an outlet.

* * * * *